US006004100A

United States Patent [19]

Przirembel et al.

[11] Patent Number: 6,004,100

[45] Date of Patent: Dec. 21, 1999

[54] TRAILING EDGE COOLING APPARATUS FOR A GAS TURBINE AIRFOIL

[75] Inventors: Hans R. Przirembel, Jupiter; Friedrich O. Soechting, Tequesta, both of Fla.

[73] Assignee: United Technologies Corporation, Hartford, Conn.

[21] Appl. No.: 08/969,670

[22] Filed: Nov. 13, 1997

[51] Int. Cl.[6] ..... F01D 5/18

[52] U.S. Cl. ..... 416/97 R

[58] Field of Search ..... 416/96 R, 96 A, 416/97 R, 97 A; 415/115, 116

[56] References Cited

U.S. PATENT DOCUMENTS

| | | | |
|---|---|---|---|
| 4,601,638 | 7/1986 | Hill et al. | 416/97 R |
| 5,342,172 | 8/1994 | Coudray et al. . | |
| 5,378,108 | 1/1995 | Zelesky | 416/97 R |
| 5,403,159 | 4/1995 | Green et al. . | |
| 5,486,093 | 1/1996 | Auxier et al. . | |
| 5,498,133 | 3/1996 | Lee . | |
| 5,605,046 | 2/1997 | Liang . | |

FOREIGN PATENT DOCUMENTS

| | | | |
|---|---|---|---|
| 767546 | 11/1952 | Germany | 416/97 R |
| 2358521 | 8/1979 | Germany | 415/115 |

*Primary Examiner*—Christopher Verdier
*Attorney, Agent, or Firm*—Richard D. Getz

[57] ABSTRACT

A hollow airfoil is provided having a pressure side wall, a suction side wall, a cavity formed between the pressure and suction side walls, a plurality of cooling ports disposed within the pressure side wall, and a plurality of passages, each extending between the cavity and one of the cooling ports. Each passage has a first wall adjacent the suction side wall, a pair of passage side walls extending substantially toward the pressure side wall, and a second wall adjacent the pressure side wall. In a first embodiment, each passage further includes a pair of fillets extending between the passage side walls and the second wall. In a second embodiment, each passage includes a jog adjacent each cooling port.

11 Claims, 2 Drawing Sheets

TRAILING EDGE COOLING APPARATUS FOR A GAS TURBINE AIRFOIL

The invention was made under a U.S. Government contract and the Government has rights herein.

BACKGROUND OF THE INVENTION

1. Technical Field

This invention relates to hollow airfoils in general, and to geometries of trailing edge cooling holes within hollow airfoils in particular.

2. Background Information

In modern axial gas turbine engines, turbine rotor blades and stator vanes require extensive cooling. A typical rotor blade or stator vane airfoil includes a serpentine arrangement of passages connected to a cooling air source, such as the compressor. Air bled from a compressor stage provides a favorable cooling medium because its pressure is higher and temperature lower than the core gas traveling through the turbine; the higher pressure forces the compressor air through the passages within the component and the lower temperature transfers heat away from the component. Cooling air ultimately exits the airfoil via cooling holes in the airfoil walls or cooling ports distributed along the trailing edge. Cooling is particularly critical along the trailing edge, where the airfoil narrows considerably. Most airfoil designs include a line of closely packed cooling ports in the exterior surface of the pressure side wall, distributed along the entire span of the airfoil. A relatively small pressure drop across each of the closely packed ports encourages the formation of a boundary layer of cooling air (film cooling) aft of the ports that helps cool and protect the aerodynamically desirable narrow trailing edge.

In addition to cooling, turbine rotor blade and stator vane airfoils must also accommodate high cycle fatigue (HCF) resulting from vibratory loadings. This is particularly true along the narrow trailing edge, where each of the closely packed cooling ports represents a significant stress concentration. Left unchecked, HCF can create stress fractures which can eventually compromise the mechanical integrity of the airfoil. FIG. 1 shows a sectional view of a conventional trailing edge with a cooling port in the pressure side wall, connected to an internal cavity via a passage. The width of the pressure side wall narrows considerably adjacent the cooling port, making that portion of the pressure side wall particularly susceptible to HCF. Moving the port forward to increase the wall thickness minimizes susceptibility to HCF, but also adversely affects film cooling aft of the port (film cooling effectiveness generally degrades with distance).

Hence, what is needed is an airfoil with trailing edge cooling apparatus that inhibits HCF, one that enhances downstream film cooling, and one that can be readily manufactured.

DISCLOSURE OF THE INVENTION

It is, therefore, an object of the present invention to provide an airfoil having trailing edge cooling apparatus that inhibits HCF.

Another object of the present invention is to provide an airfoil having trailing edge cooling apparatus that enhances downstream film cooling.

Another object of the present invention is to provide an airfoil having trailing edge cooling apparatus that can be readily manufactured.

According to the present invention, a hollow airfoil is provided having a pressure side wall, a suction side wall, a cavity formed between the pressure and suction side walls, a plurality of cooling ports disposed within the pressure side wall, and a plurality of passages, each extending between the cavity and one of the cooling ports. Each passage has a cross-section that includes a first wall adjacent the suction side wall, a pair of passage side walls, and a second wall adjacent the pressure side wall. In one embodiment, a pair of fillets is provided extending between the passage side walls and the second wall. In a second embodiment, each passage includes a jog adjacent each cooling port.

An advantage of the present invention is that HCF is minimized. In a conventional airfoil, the taper of the pressure side wall and suction side walls toward one another causes the pressure side wall to become undesirably thin, and therefore susceptible to HCF, particularly adjacent the forward and side edges of the cooling ports. In contrast, both embodiments of the present invention passages provide enough wall material around the cooling port to substantially minimize HCF in that region.

A further advantage of the present invention is that the geometry of the passages and cooling ports can be cast within an airfoil, thereby making the present invention airfoil readily manufacturable.

These and other objects, features and advantages of the present invention will become apparent in light of the detailed description of the best mode embodiment thereof, as illustrated in the accompanying drawings.

BEST MODE FOR CARRYING OUT THE INVENTION

Figure 2:
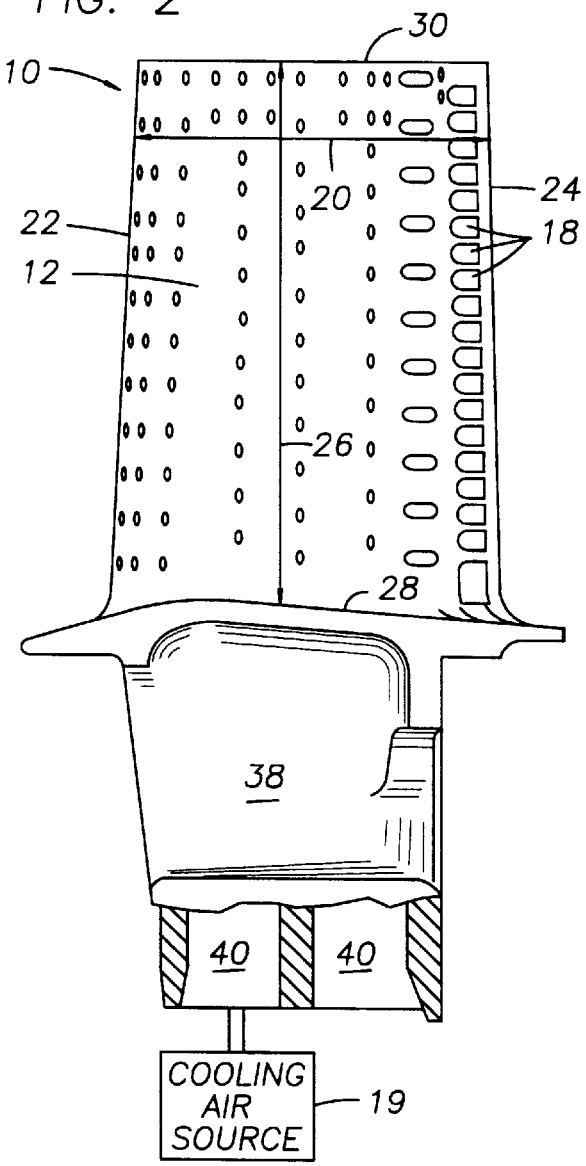
FIG. 2 is an example of an gas turbine airfoil having cooling ports distributed spanwise, adjacent the trailing edge.
Figure 3:
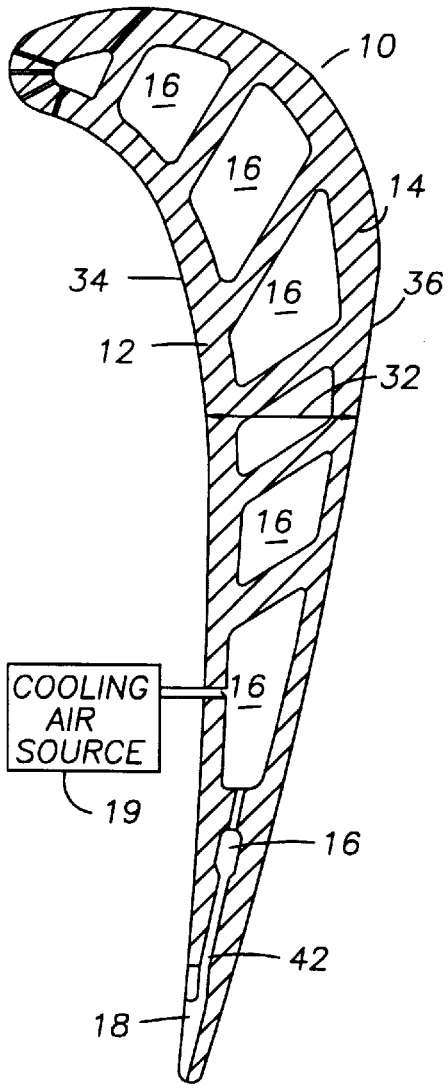
FIG. 3 is a diagrammatic cross-section of an gas turbine airfoil having a plurality of internal cavities disposed between pressure and suction side walls.

Referring to FIGS. 2 and 3, a hollow airfoil 10 for gas turbine engine includes a pressure side wall 12, a suction side wall 14, a plurality of internal cavities 16 disposed between the pressure 12 and suction 14 side walls, and a plurality of cooling ports 18. The internal cavities 16 are connected to a source of cooling air 19. The pressure 12 and suction 14 side walls extend widthwise 20 between a leading edge 22 and a trailing edge 24, and spanwise 26 between the inner radial platform 28 and an outer radial surface 30. The thickness 32 of the airfoil 10 is defined as the distance between pressure side wall exterior surface 34 and the suction side wall exterior surface 36. The thickness of an airfoil wall 12,14 may be measured in a similar direction, between the walls interior and exterior surfaces. The exemplary airfoil 10 shown in FIG. 2 is a rotor blade having a root 38 with cooling air inlets 40. An airfoil 10 acting as a stator vane may also embody the present invention. FIG. 3 shows a cross-section of an airfoil (stator vane or rotor blade) embodying the present invention, having a plurality of internal cavities 16, connected to one another in a serpentine manner. "N" number of passages 42 connect the aft most cavity 16 to "N" number of cooling ports 18, where "N" is an integer.

Figure 4A:
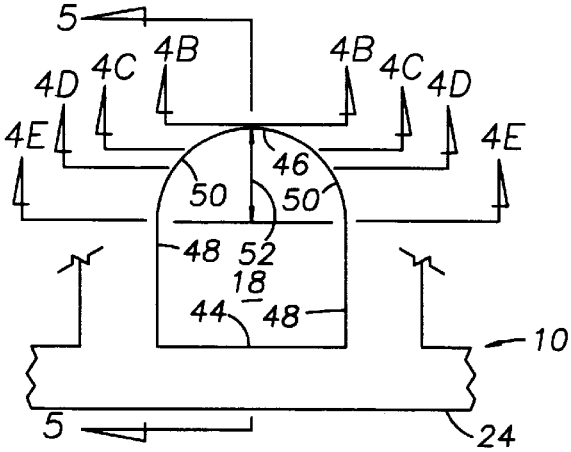
FIG. 4A is a diagrammatic view of a gas turbine airfoil having a cooling port adjacent the trailing edge of the airfoil.

Referring to FIGS. 2, 3, and 4A, the cooling ports 18 are disposed within the pressure side wall 12, and distributed spanwise adjacent the trailing edge 24. Each cooling port 18 includes an aft edge 44, a forward edge 46, a pair of side edges 48, and a pair of fillets 50 (see FIG. 4A). The side edges 48 intersect with the aft edge 44, and extend substantially toward the forward edge 46. Each fillet 50 extends between one of the side edges 48 and the forward edge 46. The length 52 of each fillet 50 is defined as the widthwise distance between its intersection with the side edge 48 and its intersection with the forward edge 46.

Figure 4B:
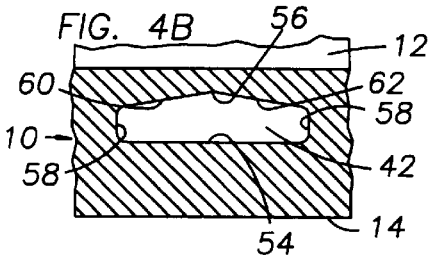
FIGS. 4B–4E and 5 are sections of the gas turbine airfoil shown in FIG. 4A
Figure 5:
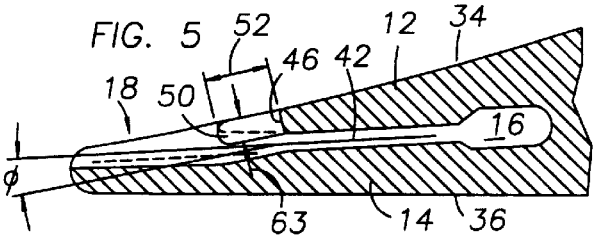
Figure 4E:
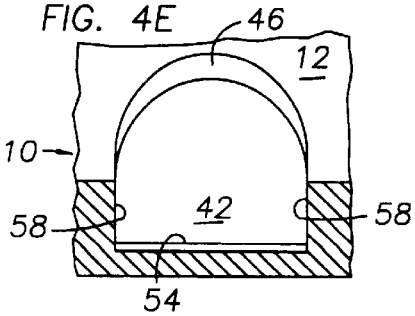
Figure 6:
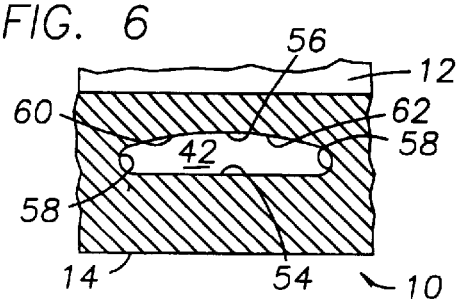
FIG. 6 is a section of the gas turbine airfoil shown in FIG. 4A, taken at the section of FIG. 4B, showing an alternative passage cross-section.

Referring to FIGS. 4B–4E, 5, and 6, each passage 42 connecting a cooling port 18 to the aft most cavity 16 (see FIG. 5) has a cross-sectional geometry that includes a first wall 54, a second wall 56, and a pair of side walls 58 (see FIGS. 4B–4E and 6). The first wall 54 is adjacent the suction side wall 14 and the second wall 56 is adjacent the pressure side wall 12. The side walls 58 extend outwardly from the first wall 54, substantially toward the pressure side wall 12. In the first embodiment of the present invention, the cross-sectional geometry of the passage 42 further includes a first fillet 60 extending between one of the side walls 58 and the second wall 56, and a second fillet 62 extending between the other of the side walls 58 and the second wall 56. The geometry of the first and second fillets 60,62 and/or the second wall 56 can be varied to suit the application at hand. FIG. 6, for example, shows the first and second fillets 60,62 and second wall 58 as arcuately shaped. FIG. 4B, on the other hand, shows a passage 42 cross-section where the fillets 60,62 nearly meet one another at the center of the second wall 56. FIG. 4B also shows the pressure side wall 12 at the forward edge 46 of the cooling port 18 having a thickness equal to "x". In the first embodiment of the present invention, the thickness of the first and second fillets 60,62 is equal to or greater than "x".

Referring to FIG. 5 in the second embodiment of the present invention, downstream of the cooling port forward edge 46, each passage 42 jogs an amount (illustrated by angle $\phi$), thereafter extending substantially parallel to the pressure side wall exterior surface 34 for at least the length 52 of the cooling port fillets 50. As a result, the thickness 63 of the pressure side wall 12 remains substantially constant for the length 52 of the cooling port fillets 50. Aft of the cooling port fillets 50, the passage preferably jogs again, this time extending substantially parallel to the exterior surface 36 of the suction side wall 14. The dotted lines in FIG. 5 represent a conventional trailing edge cooling port and passage geometry.

Figure 1A:
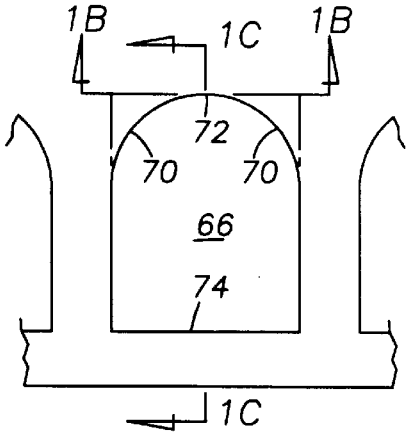
FIG. 1A PRIOR ART
FIG. 1A is a diagrammatic view of an airfoil having a cooling port adjacent the trailing edge of the airfoil.
Figure 1B:
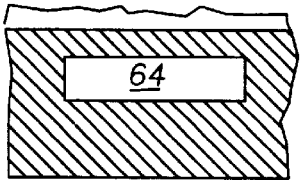
FIG. 1B PRIOR ART
FIGS. 1B and 1C are sections of the airfoil shown in FIG. 1A.
Figure 4C:
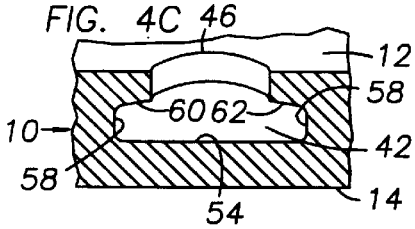
Figure 1C:
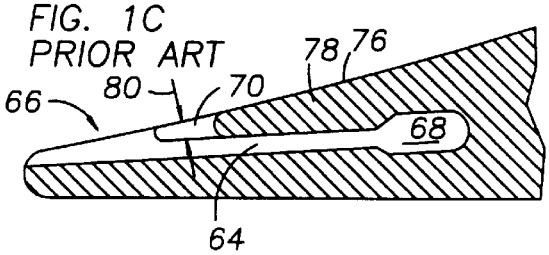
FIG. 1C PRIOR ART
Figure 4D:
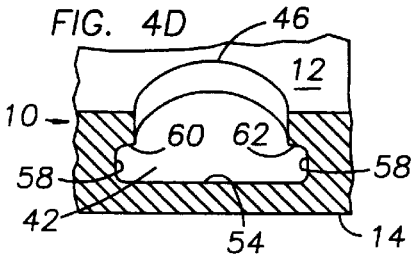

To better understand the present invention, compare the conventional trailing edge cooling apparatus shown in FIG. 1 to the present invention trailing edge cooling embodiments shown in FIG. 5. In the conventional trailing edge cross-section (FIG. 1), a passage 64 connects each cooling port 66 to the internal cavity 68, and each cooling port 66 includes a pair of fillets 70. The width of the pressure side wall 78 narrows considerably in the fillets 70, making that portion of the pressure side wall 78 particularly susceptible to HCF.

The present invention, in contrast, avoids the narrow wall characteristic of conventional design by: (1) providing a filleted 60,62 passage geometry (see FIGS. 4B–4E, and 6); and/or (2) skewing the passage 42 aft of the forward edge 46 of the cooling port, such that the passage 42 extends substantially parallel to the exterior surface 34 of the pressure side wall 12 (see FIG. 5).

Although this invention has been shown and described with respect to the detailed embodiments thereof, it will be understood by those skilled in the art that various changes in form and detail thereof may be made without departing from the spirit and the scope of the invention. For example, the present invention is described above in terms of a first and a second embodiment. The embodiments may be combined to suit particular applications.

We claim:

1. A hollow airfoil, comprising:

a pressure side wall, having a first exterior surface;

a suction side wall, having a second exterior surface;

wherein said pressure and suction side walls extend widthwise between a leading edge and a trailing edge, and spanwise between an inner radial surface and an outer radial surface;

a cavity, formed between said pressure and suction side walls, said cavity connected to a source of cooling air;

a plurality of cooling ports, disposed within said pressure side wall, distributed spanwise adjacent said trailing edge; and a plurality of passages, each extending between said cavity and one of said cooling ports, and each having a first wall adjacent said suction side wall, a pair of passage side walls extending substantially toward said pressure side wall, a second wall adjacent said pressure side wall, a first fillet extending between one of said passage side walls and said second wall, and a second fillet extending between the other of said passage side walls and said second wall.

2. A hollow airfoil according to claim 1, wherein each said passage jogs adjacent said connected cooling port, said passage extending substantially parallel to said first exterior surface.

3. A hollow airfoil according to claim 1, wherein each said cooling port comprises:

an aft edge;

a pair of side edges intersecting with said aft edge;

a forward edge;

a third fillet extending between one of said side edges and said forward edge; and a fourth fillet extending between the other of said side edges and said forward edge, said third and fourth fillets each having a length.

4. A hollow airfoil according to claim 3, wherein said pressure side wall has a first thickness adjacent said forward edge of each said cooling port, and said first and second fillets have a second thickness at least equal to said first thickness.

5. A hollow airfoil according to claim 4, wherein downstream of said forward edge, each said passage extends substantially parallel to said first exterior surface.

6. A hollow airfoil according to claim 5, wherein said passage side walls and said second wall are arcuate.

7. A hollow airfoil according to claim 5, wherein downstream of said aft edge, each said passage extends substantially parallel to said second exterior surface.

8. A hollow airfoil comprising:

a pressure side wall, having a first exterior surface;

a suction side wall, having a second exterior surface;

wherein said pressure and suction side walls extend widthwise between a leading edge and a trailing edge, and spanwise between an inner radial surface and an outer radial surface;

a cavity, formed between said pressure and suction side walls, said cavity connected to a source of cooling air;

a plurality of cooling ports, disposed within said pressure side wall, distributed spanwise adjacent said tailing edge; and a plurality of passages, each extending between said cavity and one of said cooling ports, and each having a first wall adjacent said suction side wall, a pair of passage side walls extending substantially toward said pressure side wall, and a second wall adjacent said pressure side wall;

wherein a portion of each said passage jogs adjacent said connected cooling port, and subsequently extends along a centerline substantially parallel to said first exterior surface.

9. A hollow airfoil according to claim 8, wherein each said cooling port comprises:

an aft edge;

a pair of side edges intersecting with said aft edge;

a forward edge;

a first fillet extending between one of said side edges and said forward edge; and a second fillet extending between the other of said side edges and said forward edge, said first and second fillets each having a length.

10. A hollow airfoil according to claim 9, wherein downstream of said forward edge, each said passage jogs and extends substantially parallel to said first exterior surface.

11. A hollow airfoil according to claim 10, wherein downstream of said aft edge, each said passage jogs and extends substantially parallel to said second exterior surface.

* * * * *